US005570555A

United States Patent [19]

Ferguson et al.

[11] Patent Number: 5,570,555

[45] Date of Patent: Nov. 5, 1996

[54] DOUBLE BATTED ROOF STRUCTURE

[76] Inventors: Gary Ferguson, P.O. Box 550, Rocklin, Calif. 95677; David Knutson, 1520 Main St., Sacramento, Calif. 95838; Mark Schoen, 9524 Beddinton Way, Sacramento, Calif. 95827

[21] Appl. No.: 375,607

[22] Filed: Jan. 19, 1995

[51] Int. Cl.[6] ..... E04D 1/04; E04D 3/00

[52] U.S. Cl. ..... 52/551; 52/664; 52/550; 52/535

[58] Field of Search ..... 52/535, 541, 550, 52/551, 664

[56] References Cited

U.S. PATENT DOCUMENTS

| | | | |
|---|---|---|---|
| 1,798,380 | 3/1931 | Martin | 52/551 |
| 2,109,673 | 3/1938 | McGee | 52/551 X |
| 3,095,671 | 7/1963 | Fink et al. | 52/551 |
| 4,015,392 | 4/1977 | Eaton | 52/541 X |
| 4,106,253 | 8/1978 | Aarons | 52/550 X |
| 4,958,471 | 9/1990 | Waddington | 52/550 X |
| 5,060,444 | 10/1991 | Paquette | 52/535 |

FOREIGN PATENT DOCUMENTS

| | | | |
|---|---|---|---|
| 1111365 | 7/1961 | Germany | 52/550 |

*Primary Examiner*—Wynn E. Wood
*Attorney, Agent, or Firm*—Marc C. Jacobs

[57] ABSTRACT

A double batted roof structure which consists in order of placement upon the roof rafters of a building, skip sheathing, a series of spaced vertically disposed members of metal first hat track, an insulative sheathing layer, a series of spaced horizontal members of second hat track, and conventional cement tiles.

15 Claims, 3 Drawing Sheets

DOUBLE BATTED ROOF STRUCTURE

BACKGROUND OF THE INVENTION

The roofing business has been around ever since man decided he wanted to live somewhere other than in a cave. For many years, Californians utilized cedar shakes as the roofing material of choice. Devastating fires such as the one that took place in the Berkeley hills have caused many fire marshalls to take steps to induce the populace to take steps to utilize materials other than wood shakes when re-roofing or building a new roof.

One such material in current fashion is the cement tile. Those in the reroofing industry are aware of the fact that in their industry as in every field if you build a better mousetrap, people will buy it. So too is it true in the construction trades.

Accordingly it is an object of this invention to provide an improved reroofing structure.

It is another object to provide a new roofing structure that reduces the amount of wood used in fashioning a roof.

Still another object is to provide a new self-furring mode of roof construction for concrete tile roofs.

Yet another object is to provide a roof that is based on metal and concrete tile, yet is cost competitive with shake and shingle covered wood based roofs.

A still further object is to provide roof construction that uses spaced metallic hat track extrusions running in two directions.

A further object is to provide ventilation of attic and space under the tile to make roof cooler in summer and warmer in the winter.

A yet further object is to provide a new type of metal based double batted roof structure.

Other objects of the invention will in part be obvious and will in part appear hereinafter.

The invention accordingly comprises the apparatus possessing the features properties and the relation of components which are exemplified in the following detailed disclosure and the scope of the application of which will be indicated in the appended claims.

For a fuller understanding of the nature and objects of the invention reference should be made to the following detailed description, taken in conjunction with the accompanying drawings.

SUMMARY OF THE INVENTION

A mode of roof construction that utilizes standard skip sheathing as its base upon the rafters. The skip sheathing is overlaid with horizontally spaced first metallic hat track roll formed members running vertically along the down slope of the roof. Thermo-ply™ or similar sheathing is placed over the first hat track and attached thereto. Second vertically spaced hat track roll formed members are placed horizontally along the length of the roof and secured through the sheathing to the first hat track series. Predrilled conventional lip bearing concrete tiles are laid in place from the bottom of the roof toward the top, and are then secured to the second hat track set as each is laid into position.

DESCRIPTION OF THE PREFERRED EMBODIMENT

Figure 1:
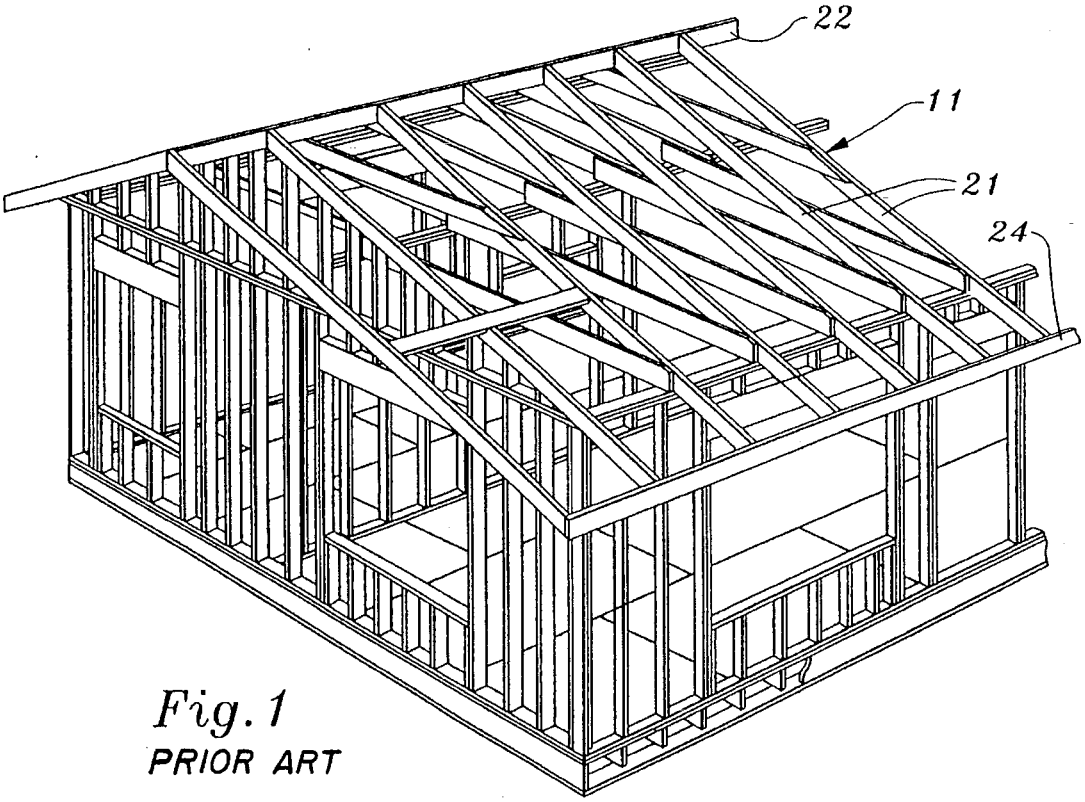
Fig. 1 PRIOR ART
FIG. 1 is perspective view of a framed out unenclosed house.

FIG. 1 depicts a typical home 10, having just been framed out, the siding and roofing for which have not as yet been put in place. As is well known in the construction trade, home 10 includes roof framing 11, comprised of a series of angularly disposed spaced vertical rafters 21 each attached at one end, the upper end, to a ridgeboard 22 and each attached at the lower end to a fascia board 24.

Figure 2:
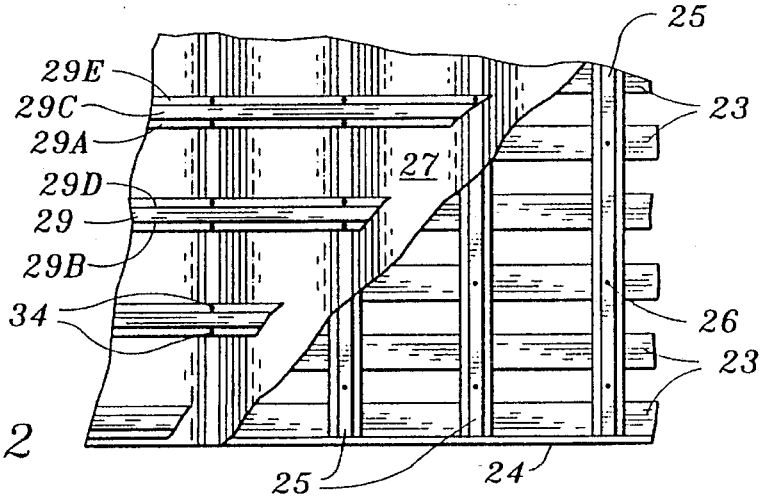
FIG. 2 is a close-up elevational view of part of a roof structure according to this invention.

The discussion now moves to FIG. 2, a close-up view of a roof segment according to this invention. Rafter 21 is seen to be attached at its upper end to ridgeboard 22. The fascia 24 to which the lower end of the rafter would be attached is not seen in this view.

After the roof framing 11, is completed, one inch by four inch (1"×4") fir or pine skip sheathing boards 23, also known in the trade as spaced sheathing, are conventionally nailed to the series of rafters.

Horizontally spaced first hat track members 25 are secured generally vertically to approximately every other skip sheathing member 23 via screws or nails, 26. Typically these hat track members are 1½ inch 20 gauge sheet metal units. Application of the first hat track members 25 is preferably done with **#16*d* screw shank nails, though other suitable means may be employed, which screws are inserted through the horizontal top member 25**C.

Figure 9:
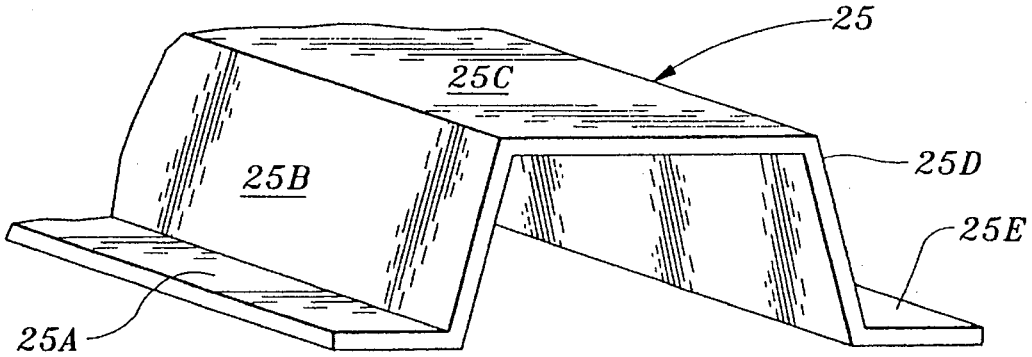
FIG. 9 is a perspective view of one component used in this invention.

While it has been mentioned that this invention uses first and second hat track members, the difference between the two lies in the dimensions, and direction of placement. The overall configuration of the metal roll formed members is the same however. Reference therefore is made to FIG. 9 which shows the configuration of this first hat track member. As can be seen member 25 has a cross section which includes a pair of oppositely directed horizontal flanges, 25A, 25E, each of which is connected on its inner edge to an inwardly and upwardly directed intermediate section, 25B and 25D. The higher of the two edges of the angularly disposed sections also form the outer edges of a top horizontal section, 25C.

Hat track is a metal member generally utilized in the plaster and lath trade, and not believed to have found previous utility in the roofing industry in this manner. Hat track members are made by Steller, McElroy among others out of galvanized steel and are sold in 20 foot lengths. The hat track members are installed above the existing rafters and fastened by driving 16*d* screw shank nails through the top horizontal section of the hat track, through the wood skip sheathing and into the underlying rafters, which may vary from 12 to 24-inch on center.

The next step is to lay down and secure an insulation layer 27; namely, the insulative sheathing. Applicants have found that several types of insulation layers can be employed. First to be mentioned is INSULAYMENT™ made by Simplex Products Division. This product designated Type III by the manufacturer is a strong lightweight underlayment for concrete tile having a nominal thickness of 9.6 mils and is comprised of woven polyolefin fabric laminated to a kraft foil sheet, and has a silver-gray appearance.

Figure 3:
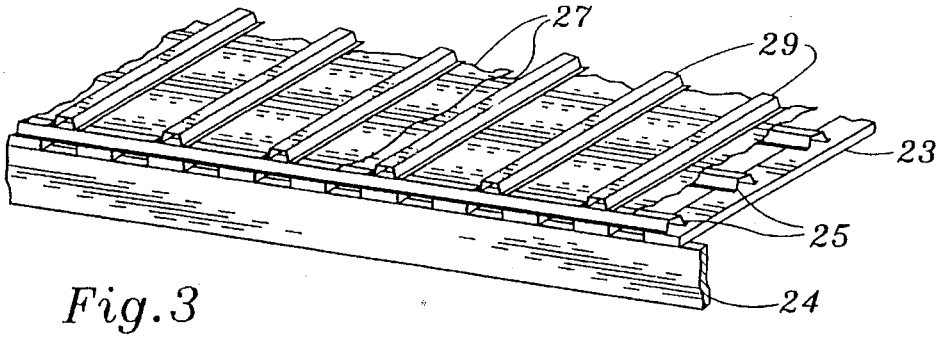
FIG. 3 is an end perspective view of a part of a roof structure according to this invention.
Figure 4:
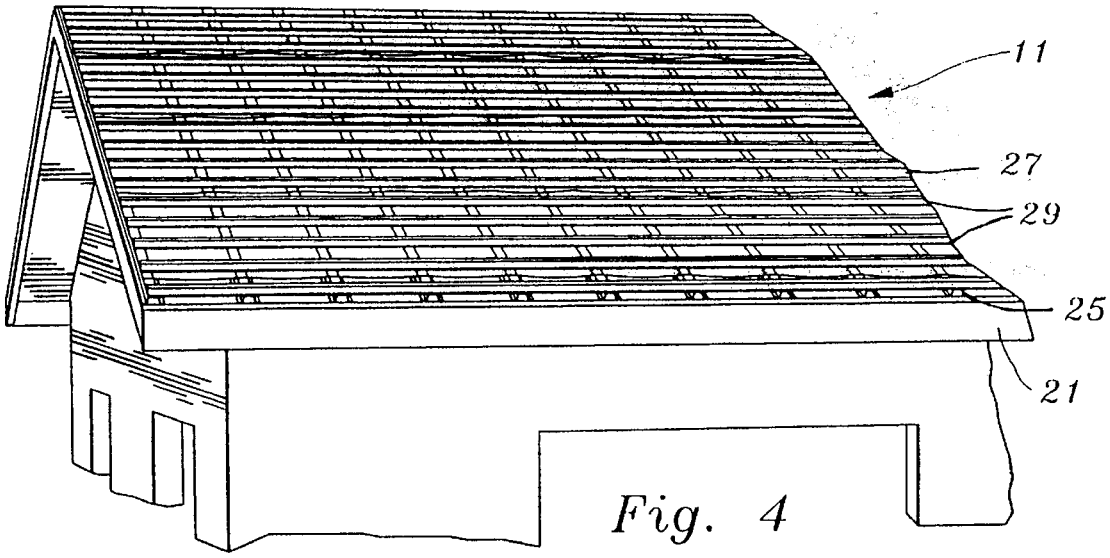
FIG. 4 is perspective view of a partially completed roof section according to this invention.

The preferred insulative sheathing is THERMO-PLY™ also made by Simplex Products Division. The materials offered is 100-inch long sheets, 48-inches wide. The material comprises plies of weather and water resistant fibers that are adhesively laminated under pressure, followed by a coating of polyethylene on one side of the laminate, and a bonding of a reflective aluminum foil to the other. This material is stronger than foam or fiberboard sheathing and resists puncture, breakage and is not prone to termites. The sheathing product offers sheer resistance, a characteristic which is not available from the Insulayment product. The insulative sheathing is applied to the first hat track members by using #8 self-drilling screws through the layer 27 into the top horizontal section of the hat track 25. The sheathing should NOT be pulled tight, but rather be allowed to drape or form waves, i.e., lay down to create valleys between adjacent hat track members 25. See FIG. 3 and especially FIG. 4 which illustrates this point.

Obviously other insulative materials may be utilized for the insulative sheathing, provided that they bear the following characteristics:

(a) overall thickness and flexibility permits the draping effect to transpire, (b) possession of waterproof property to serve as underlayment for tile; and (c) reflective insulative barrier.

Figure 7:
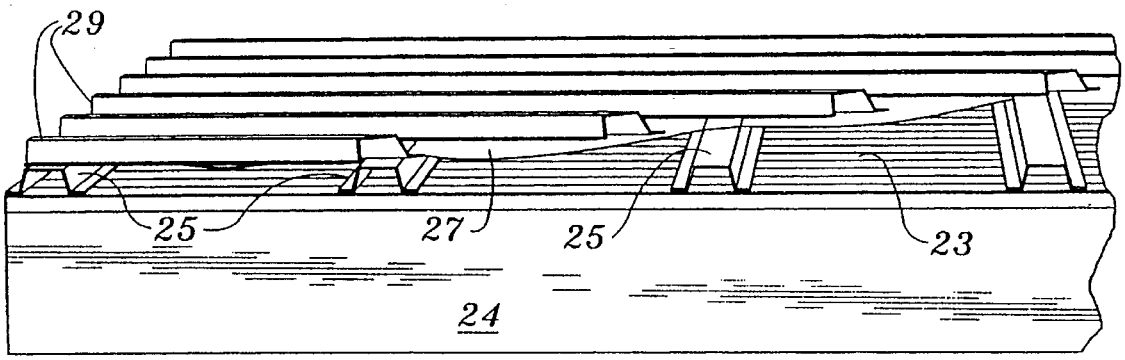
FIG. 7 is a side perspective view of a roof section under construction acceding to this invention.

Subsequent to the application of the insulative layer, 27, the transverse hat track 29 is secured in place. See FIGS. 2, 3, and 4. This second hat track 29 is similar to the first hat track, but is of a ⅞ths inch height, preferably 20 gauge every 12 to 14 inches, depending on the size of the tile chosen. As is seen in FIG. 7, member 29 has a cross section which includes a pair of oppositely directed horizontal flanges, 29A, 29E, each of which is connected on its inner edge to an inwardly and upwardly directed intermediate section, 29B and 29D. The higher of the two edges of the angularly disposed sections also form the outer edges of a top horizontal section, 29C. This second hat track is secured using the #8 self-drilling screws. These screws 34, seen in FIG. 2, are applied through the flanges 29A and 29B, and through the insulative sheathing into the first hat track's horizontal top section. These screws 34 are applied again at 16" centers, the spacing of the first hat tracks 25.

One should then inspect to make sure that all of the insulative layer and the top hat track are securely fastened in place, prior to commencing the application of the individual cement tiles.

Figure 5A:
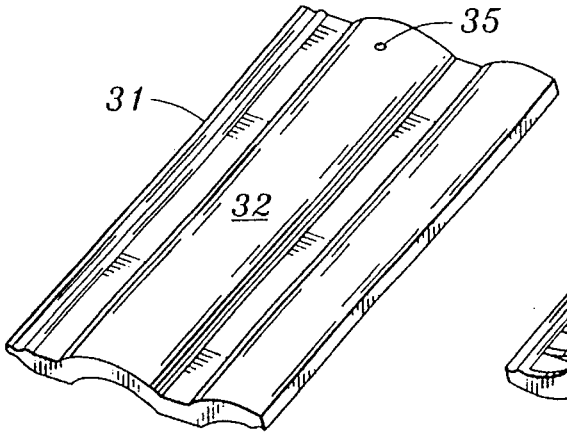
FIG. 5A is the reverse side of a conventional nail on roof tile employed in this invention.
Figure 5B:
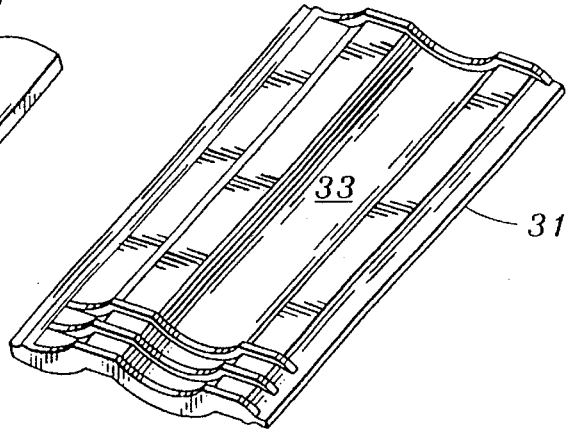
FIG. 5B is the reverse side of the tile of FIG. 5A.

Reference should now be made to FIGS. 5A and 5B. These in turn depict the obverse side 32 of a common cement roof tile, 31 (see FIG. 5A), while FIG. 5B depicts the reverse or underside of such a tile, 33. These tiles are made by various manufacturers and are considered a staple item of commerce. Most such tiles include a partial or full bore 35, per FIG. 5A for securing the tile in place once it is correctly positioned.

Figure 6:
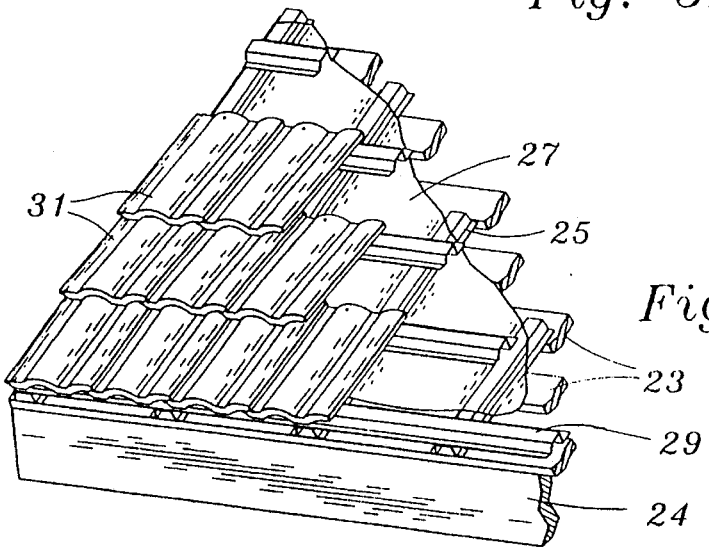
FIG. 6 is a close-up perspective view of a roof section as the course of tiles is being placed into its in use position.
Figure 8:
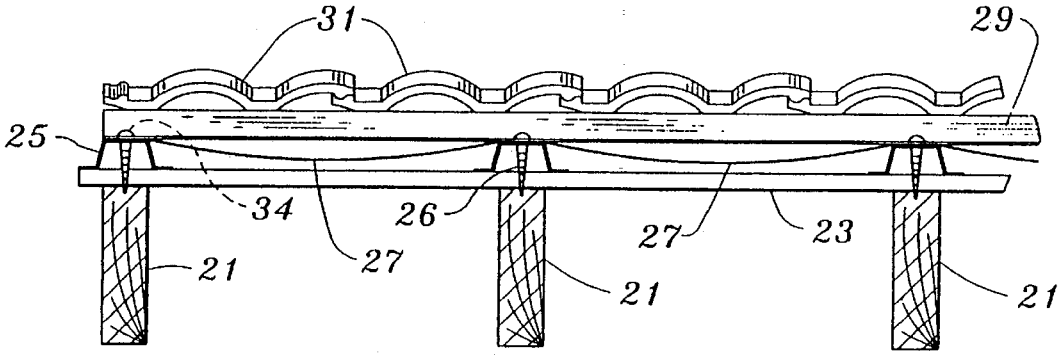
FIG. 8 is a diagrammatic view of the roof structure according to this invention depicting the various layers of materials that go into the total construction.

These tiles also include at least one or two, here two transverse ridges near the bottom of the tile on the reverse side. These ridges serve as a reinforcement for the tile pieces and also to make the laps weather tight. Such tiles also include a top lip which projects rearwardly, and is used to correctly position the tile upon its support, here the second hat track 29. See FIGS. 6 and 8. The bore aforementioned is used to receive a fastener such as a self-tapping galvanized screw, not seen, which is inserted into the support, here hat track 29 to prevent the individual tile from being lifted off as by wind or vandalism. The bore 35 is spaced down from the thickness of the lip 37. As noted earlier, not all tiles have the throughbore for fastening. The need to attach the tile to its support is directly related to the pitch of the roof. It is within the skill of the art to determine such a need.

Tiles are laid out in conventional fashion, beginning at the lower end of the roof and working toward the ridge line. No invention is claimed in the manner of applying the tile roofing to the roof framing.

Other tiles different in appearance from those of FIG. 5 can be employed. The common feature required for operation is that tile should have an upper lip such as is seen in FIG. 5B to permit the tile to rest on the second hat track.

The term roof framing as used herein applies to the combination of the various layers upon the rafters of the building; namely, the skip sheathing, the first hat track the insulative layer, and the second hat track. See FIG. 7. The term roofing as used herein applies to the covering over the roof framing; namely, the cement tiles.

As is known in the industry, the tiles are laid one next to the other horizontally with sides abutting, and the second course or next row is laid offset ½ tile to the right or left as the case may be and partially covering a portion of the tile below to the right and to left, and most importantly the butt edge between the two adjacent tiles of the course below. Again, such tile laying is deemed conventional to the art.

As each course or row of tile is positioned into place, such that the bottom edge 38 of the lip 37 rests upon the surface 29D of the hat track 29, a screw is inserted through the bore 35 into surface 29C, the top horizontal surface of the hat track 29. Then the next course is positioned and fastened in the off set position as stated above.

In this invention we utilize hat track that is 1½ inches wide for the first track 25, and hat track that is 1¼ inches wide for the second hat track 29. This distinction in size is not necessary, in that the same larger or smaller dimension track will serve both functions, but the preferred mode is to make the distinction because it provides the greatest increase in strength, the greatest ventilation, with the least materials and the least increase in roof height.

Previously we have made reference to the fact that this roof structure is self-furring. That is, if one of the rafters such on a load bearing wall has a major sag such that shadows would be detected after the roof was to be completed, one may double up the thickness of the first hat track on the rafter with the sag, to compensate for the inward detention due to presence of the sag. This is accomplished by merely piggybacking one member of first hat track 25 upon another member, and then nailing, riveting or otherwise securing one on top of the other. Nails or other fasteners should be applied from the side, i.e., along walls 29B and 29D. No drawing of this is deemed necessary as a typical piece of hat track is already shown individually in the drawings. Doubling of the thickness of the hat track raises the elevation about ⅛th inch, enough to compensate for most slight sags. Even tripling the hat track is feasible, if necessary, since the members of the same span will mesh into one another when overlaid. This is why we have designated the hat track material to be self-furring or self-shimmying.

Should water get in under one of the tiles up by the ridge board, the water will flow down the drape of the insulative layer, and out the bottom to the gutter, if present.

It has been found that the roof structure of this invention can be constructed to be cost competitive to a conventional wood shake roof for any inclined residential roof, even though the individual cement tiles cost more than the individual cedar shakes when life cycle calculations are made.

While this invention is not price competitive with a shake roof, it is price competitive with other methods of applying tile. Also it should be remembered that shakes only last 15–20 years at best, and may very well be illegal in the near future due to code modifications which will probably incorporate fire proofing requirements for roofing.

The secret to success is the specific use of the hat track members, rather than square or rectangular stock. The hat tracks used in both directions, can be easily applied, and have the ability to be attached through either the flange or the top horizontal surface. Time and effort as well as money is saved, because the hat track has the stiffness of a solid member, but does not offer the resistance to screws, i.e., more time spent in driving, as does a solid rectangular metal bar. And, of course, flat relatively thin flat stock would not offer the strength and resistance of the hat track's configuration. It should also be noted that ofttimes, hat track is also referred to as hat channel. Both the first and second hat tracks add a degree of structural strength to the roof, which strength is not available form other materials.

Yet another benefit is obtained from the specific choice of hat track for the vertical and horizontal spaced members. That benefit is symmetry. The balance on each side of the center axis makes for balance of the load, and a lack of flexing or the desire to flex when attached in place, as could be the case from the use of some other architectural shaped material.

The reader is advised that it is believed necessary for the hat track to be made of preferably galvanized steel, and not a strong plastic such as Polycarbonate. Plastic parts suffer from time dependent deflections, and steel does not. Plastics even with incorporated fire retardant plastics are not fireproof. They lose their strength as temperatures rise during a fir much sooner than steel bends or melts. Time dependent deflections are illustrated in the home when one extends a loaded wood or more particularly flake board book shelf over a distance of 3 or 4 feet. After a while it begins to sag. That sag is a time dependent deflection.

It is to be understood that the term roof structure as used herein means the integrated unit consisting of the sheathing, first hat track members, insulative layer and second hat track members. The term roof as used herein means the roof structure and also the ceramic tiles thereupon which tiles in the industry are referred to unto themselves as a roofing material.

Since certain changes may be made in the above described apparatus without departing from the scope of the invention herein involved, it is intended that all matter contained in the above description and shown in the accompanying drawings shall be interpreted as illustrative and not in a limiting sense.

We claim:

1. A cement tile roof for a building having roof rafters, which roof comprises:

(a) roof rafters;

(b) a layer of skip sheathing secured to the roof rafters of the building;

(c) a series of nestable first hat track members spaced from each other and secured to said skip sheathing;

(d) a layer of insulative sheathing attached to said first hat track members;

(e) a series of nestable second hat track members spaced from each other and secured to said layer of insulative sheathing;

(f) adequate cement tiles laid in place over the second hat track members to cover all of said second hat track members.

2. A roof structure for cement tiles for a building having roof rafters, which roof structure comprises:

(a) roof rafters;

(b) a layer of skip sheathing secured to the roof rafters of the building;

(c) a series of nestable first hat track members spaced from each other and secured to said skip sheathing;

(d) a layer of insulative sheathing attached to said first hat track members;

(e) a series of second hat track members spaced from each other and secured to said layer of insulative sheathing and adapted to receive roofing tiles.

3. The roof of claim 1 wherein the first hat track members have oppositely directed flanges, and said members are laid generally vertically with their flanges abutting the skip sheathing.

4. The roof structure of claim 2 wherein the first hat track members have oppositely directed flanges, and said members are laid generally vertically with their flanges abutting the skip sheathing.

5. The roof of claim 1 wherein the insulative layer is a material which comprises plies of weather and water resistant fibers that are adhesively laminated under pressure, followed by a coating of polyethylene on one side of the laminate, and a bonding of a reflective aluminum foil to the other.

6. The roof structure of claim 2 wherein the insulative layer is a material which comprises plies of weather and water resistant fibers that are adhesively laminated under pressure, followed by a coating of polyethylene on one side of the laminate, and a bonding of a reflective aluminum foil to the other.

7. The roof of claim 1 wherein the second hat track members have oppositely directed flanges and are laid out vertically spaced from each other in a generally horizontal direction with their flanges touching the insulative layer.

8. The roof structure of claim 2 wherein the second hat track members have oppositely directed flanges and are laid out vertically spaced from each other in a generally horizontal direction with their flanges touching the insulative layer.

9. The process of installing a roof structure upon a building having roof rafters, which process comprises:

(a) securing a layer of skip sheathing to the roof rafters;

(b) securing a series of nestable first spaced hat track members to the skip sheathing;

(c)securing a layer of insulative sheathing to said first hat track members;

(d) securing a series of nestable spaced second hat track members to said insulative sheathing in a generally horizontal direction.

10. The process of installing a new ceramic tile roof upon a building having roof rafters, which process comprises:

(a) securing a layer of skip sheathing to the roof rafters;

(b) securing a series of nestable first spaced hat track members to the skip sheathing;

(c) securing a layer of insulative sheathing to said first hat track members;

(d) securing a series of nestable spaced second hat track members to said insulative sheathing in a generally horizontal direction; and (e) installing a series of ceramic tile members over said second hat track members.

11. The process of claim 10 wherein the installing step comprises laying the tiles in place and then nailing them to the second hat track.

12. The process of claim 9 wherein the series of first spaced hat track members are secured in a horizontally spaced relationship by screwing them to the skip sheathing.

13. The process of claim 10 wherein the series of first spaced hat track members are secured in a horizontally spaced relationship by screwing them to the skip sheathing.

14. The process of claim 9 wherein the two series of hat track members are laid out 16 inches on center in each direction.

15. The process of claim 10 wherein the two series of hat track members are laid out 16 inches on center in each direction.

* * * * *